United States Patent [19]

Krasser

[11] 4,148,002

[45] Apr. 3, 1979

[54] ELECTRIC SWITCHES

[75] Inventor: Fritz Krasser, Altdorf, Fed. Rep. of Germany

[73] Assignee: Ellenberger & Poensgen GmbH, Altdorf, Fed. Rep. of Germany

[21] Appl. No.: 746,103

[22] Filed: Nov. 30, 1976

[30] Foreign Application Priority Data

Dec. 29, 1975 [DE] Fed. Rep. of Germany ..... 2558942

[51] Int. Cl.[2] ..... H01H 71/16

[52] U.S. Cl. ..... 337/74; 200/67 C; 200/68; 200/153 G; 200/339; 337/64

[58] Field of Search ..... 337/64, 74, 75; 200/339, 67 C, 68, 294, 295, 296, 307, DIG. 6, 153 G, 153 H

[56] References Cited

U.S. PATENT DOCUMENTS

| | | | |
|---|---|---|---|
| 2,249,122 | 7/1941 | Edwards | 200/307 |
| 2,907,852 | 10/1959 | Long et al. | 200/295 X |
| 2,961,513 | 11/1960 | Wood | 337/74 X |
| 3,040,140 | 6/1962 | Nimylowycz | 200/DIG. 6 |
| 3,137,776 | 6/1964 | Maeda et al. | 337/64 X |
| 3,469,222 | 9/1969 | Brackett, Sr. | 337/74 |
| 3,510,818 | 5/1970 | Myers | 337/74 X |
| 3,879,592 | 4/1975 | Comerford | 200/339 |

FOREIGN PATENT DOCUMENTS

| | | |
|---|---|---|
| 538314 | 6/1955 | Belgium. |
| 901983 | 8/1945 | France. |

*Primary Examiner*—Harold J. Tudor
*Attorney, Agent, or Firm*—Spencer & Kaye

[57] ABSTRACT

An electric on-off switch which may optionally include a thermal trip including a bimetal strip.

The switch comprises a housing having therein a stationary contact which is engageable by a movable contact carried by a contact spring. The spring is actuated by a mechanism including a tiltable operating lever which carries a release lever. An operating cam is provided on the release lever for depressing the contact spring and causing the movable contact to engage the stational contact.

When the switch includes a directly or indirectly heated bimetal strip, the release lever is pivotally carried by the operating lever which carries a torsion spring. The torsion spring biases the release lever into contact with a set screw secured to the bimetal strip and also urges the cam into contact with the contact spring. A pivotally mounted, elongate lever is preferably disposed between the set screw and the release lever. When the switch is tripped due to excess current the bimetal strip bows and displaces the cam from the contact spring and thereby allows the contacts to separate.

The switch may be provided with a U-shaped mounting frame which can be oriented to one of two different positions. Also two or more switches may be ganged together and held together by a U-shaped bracket. A common rocker may be connected to the operating levers of the switches.

5 Claims, 8 Drawing Figures

ELECTRIC SWITCHES

The present invention relates to an electric switch and more particularly the present invention relates to a switch having a tiltable operating lever and a contact spring, the movable contact piece of which is adapted to be brought into or out of engagement with a stationary counter contact piece when the operating lever is actuated. Optionally the switch may have a bimetal strip for the purpose of thermal release and trip-free release facility.

A switch of this kind is known (German Patent Specification No. 694,107) in which the operating lever, which is designed as a rocker, acts on the contact spring by means of a cam rigidly secured thereto and via a toggle linkage the two arms of which are guided in the housing by means of bolts or studs secured to their free ends. A joint formed by the interconnection of the arms of the toggle linkage, bears on a latching lever which is retained in the latching position by a retaining yoke onto which a bimetal strip is adapted to act. The manufacture of the known rocker switch is rendered more difficult and more costly as a result of a toggle linkage and a latching lever being used.

According to the present invention there is provided an electric switch comprising a housing containing a stationary contact, a movable contact secured to a spring and a switch actuating mechanism including a tiltable operating lever, a release lever carried by the operating lever and an operating cam on the release lever, the operating cam, in an ON position of the switch, being effective to act on the contact spring to engage the movable contact with the stationary contact.

If desired the switch in accordance with the present invention may include a directly or indirectly heated bimetal strip for thermal and trip-free release of the movable contact from the stationary contact at the occurrence of an excess current.

In the same way as the known rocker switch, so also can the switch in accordance with the invention be switched on and off by actuation of the operating lever. In this context the operating cam secured to the release lever acts in simple manner directly on the contact spring, whereby a great frequency of switching operations is attained. When the switch in accordance with the invention is provided with a bimetal strip, then the release lever is pivoted when this bimetal strip is bowed, whereby the operating cam is brought out of engagement with the contact spring so that the latter, as a result of its inherent resilience, causes its movable contact piece to disengage from the stationary counter contact piece. This release occurs also with the rocker constrained in the ON position. Thus the switch in accordance with the invention also possesses trip-free release facility, as does the known rocker switch.

In order to prevent the contact spring remaining engaged by the operating cam of the release lever while the bimetal strip is still bowed, a plate-shaped lever may be pivotably mounted in the switch housing, which lever is adapted to be urged against the release lever by a set screw fixed into the bimetal strip. Thus the switch in accordance with the invention can only be properly actuated when the bimetal strip has cooled off.

Furthermore, a torque-exerting coiled spring may be disposed on the shaft of the operating lever, one leg of which spring acts on the release lever in such manner that the operating cam is thereby held in engagement with the contact spring and the release lever is pressed against the set screw of the bimetal strip. The coiled spring thus fulfills a dual function, whereby a further simplification of the switch in accordance with the invention results.

A mounting frame may be clipped onto the switch housing of the switch in accordance with the invention to provide a simple means of installing or mounting the switch in accordance with the invention.

The mounting frame may be formed as a one piece stamping and bent to U-shape, its U legs adhering to oppositely situated parallel wide sides of the switch housing and each having two mutually aligned U-shaped recesses whereby two respective resilient vertical tongues are formed in each U leg. Additionally, the oppositely situated parallel wide sides of the switch housing have shallow depressions the edges of which support the two U legs and the tongues. As a result of this design feature both the production and the installation of the switch in accordance with the invention are appreciably simplified and rendered less costly. Moreover, as a result of this design feature the mounting frame can be clipped onto the switch housing at two different levels displaced by 180° relative to one another.

The present invention also provides a switch arrangement comprising at least two switches in accordance with the invention arranged with their wide sides contacting one another and to hold them united by means of a U-shaped bracket fitted over the operating levers, with the U legs of the bracket clamping the switches together. A common rocker is provided to connect the operating levers of the switches together. The switches used in this switch arrangement may all be provided with a bimetal strip for thermal tripping. Alternatively only one switch may be provided with a bimetal strip whilst the other switch or switches may be switched on or off by hand so that it is a purely mechanical switch. In a further alternative, both or all switches may be designed as purely mechanical on-off switches.

The present invention will now be described, by way of example, with reference to the accompanying drawings, in which.

Figure 1:
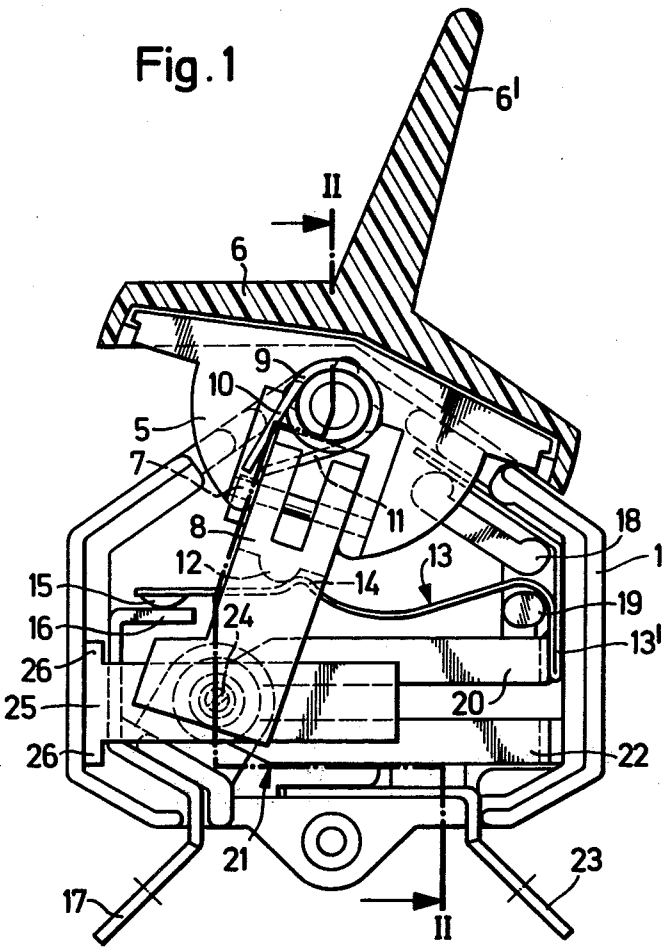
FIG. 1 is a view in the direction of the arrow I in FIG. 2 through a switch in accordance with the invention, the switch being in its ON position.
Figure 4:
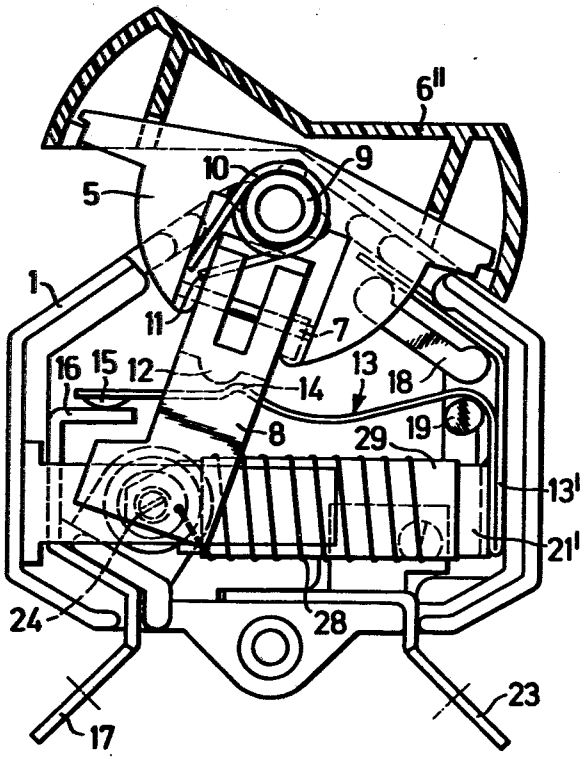
Figure 6:
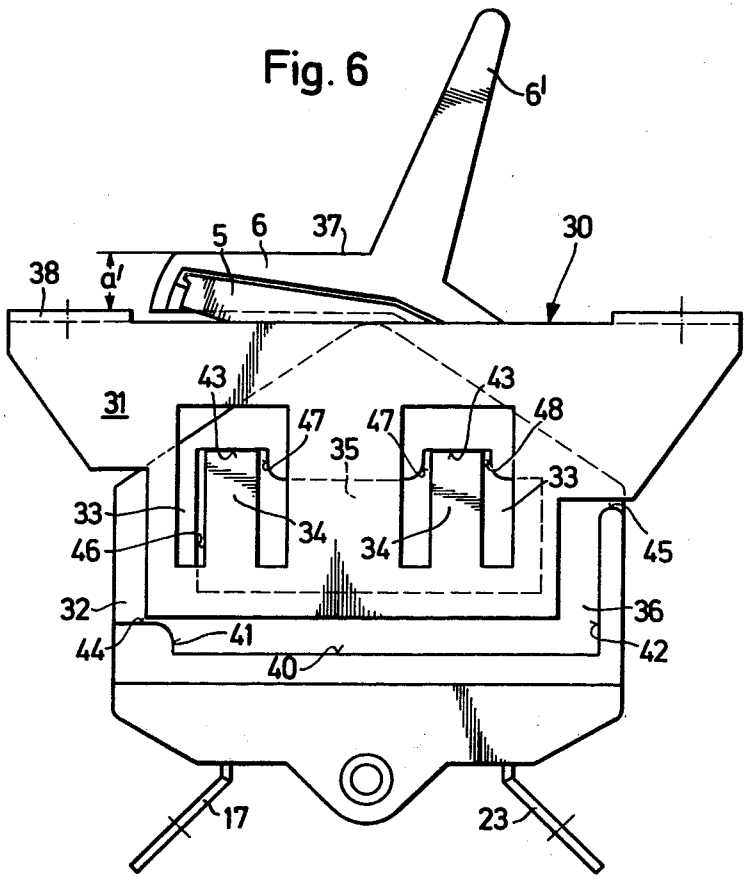
Figure 5:
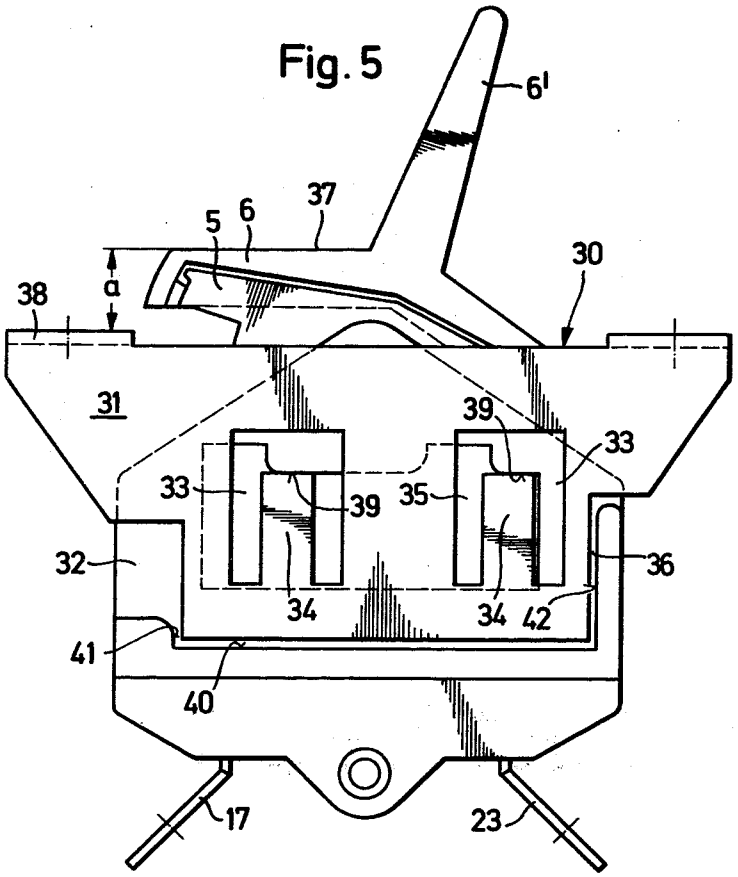
Figure 8:
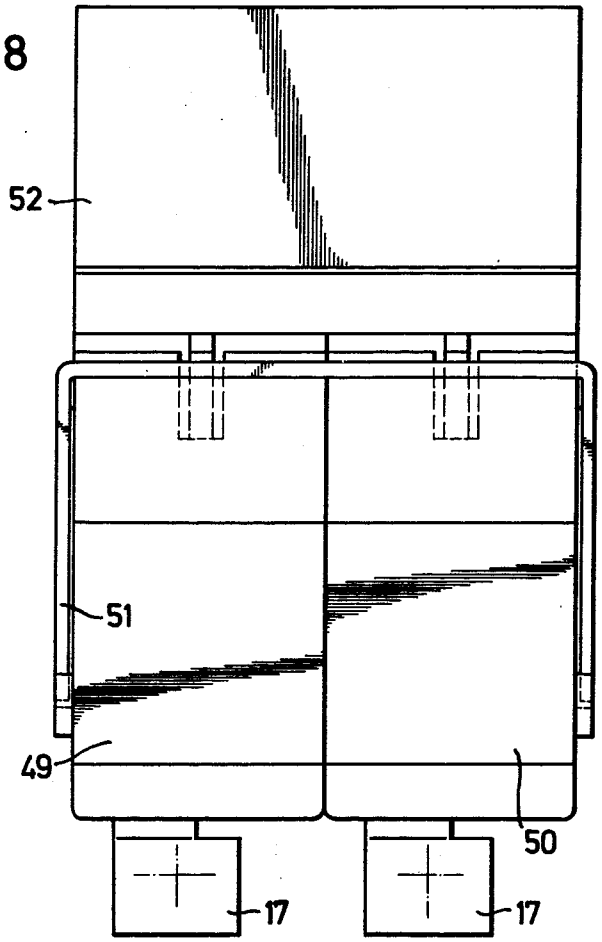
Figure 7:
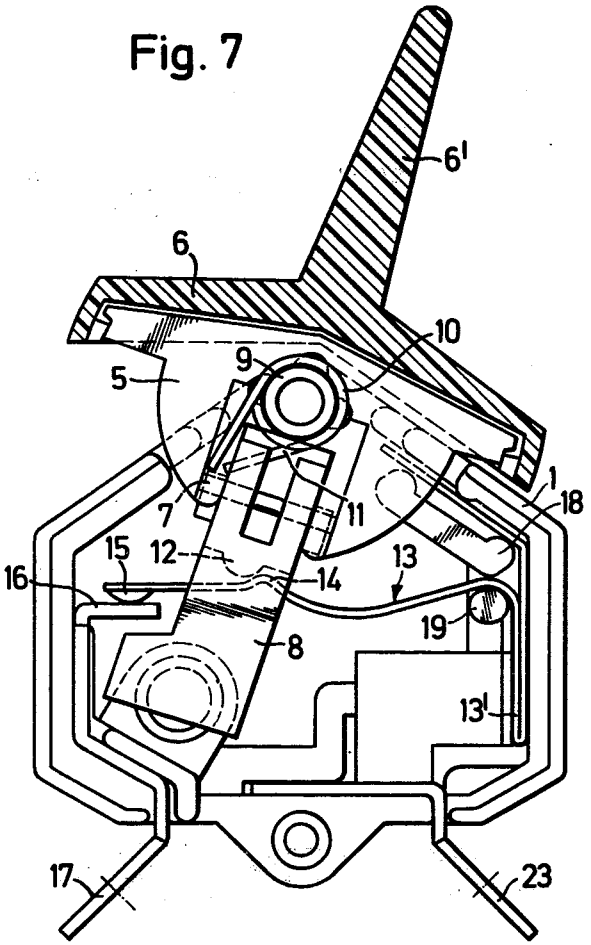

FIG. 4 is a view similar to FIG. 1 of an embodiment of a switch including an indirectly heated bimetal strip, FIG. 5 is a view of an encased switch with a mounting frame fitted thereon, FIG. 6 is a view similar to FIG. 5, the mounting frame being situated in a higher position relative to the switch housing, FIG. 7 is a view similar to FIG. 1, of another embodiment of a switch which does not have a bimetal strip, and FIG. 8 is a view of an arrangement of two switches, the longer sides of which abut one another, the housings of which switches are held against one another by a U-shaped clamp clipped on from above and the two operating levers of which switches are interconnected by a common engageable rocker.

Figure 2:
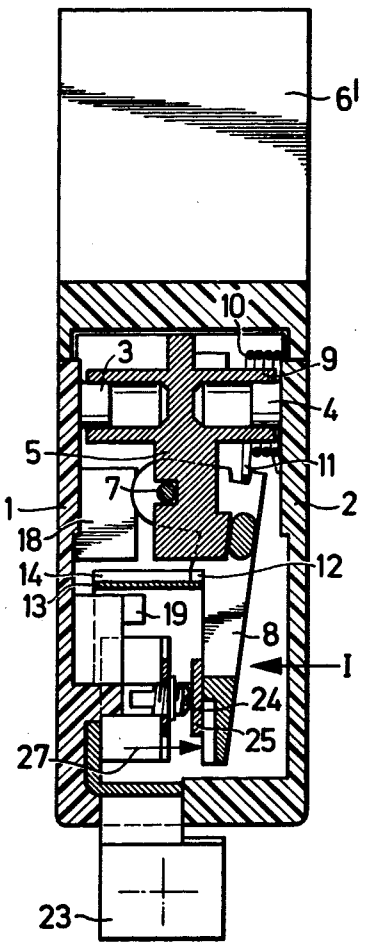
FIG. 2 shows a section on the line II—II of FIG. 1.

The switch shown in FIGS. 1 and 2 has an elongate housing consisting of two housing halves 1 and 2. Each housing half 1 and 2 has moulded thereon a respective stub shaft 3, 4 on which an operating lever 5 is pivotably mounted. On the operating lever 5 there is engaged a rocker 6 having an attachment 6' moulded thereon. A release lever 8 is pivotably mounted to the operating lever 5 by means of a pin 7. On a hollow shaft 9 of the operating lever 5 there is disposed a torque-exerting coiled spring 10 one arm of which is supported by the housing half 2 and the other arm 11 of which acts on the release lever 8 at a location which is eccentric relative to the pin 7. The release lever 8 has an operating cam 12 applied against a contact spring 13 provided with a protuberance 14 situated substantially halfway along the spring 13 and cooperating with the cam 12. The contact spring 13 has a movable contact piece 15 which, in the ON position illustrated in FIG. 1, contacts a stationary counter contact piece 16. The stationary counter contact piece 16 forms part of a connecting lug 17. As shown in FIG. 1 the righthand end of the contact spring 13 is bent 180° to form a loop 13' and it is so inserted, with bias, between the external wall of the housing half 1 and projections 18 and 19 of the housing wall 1, that a simple and effective mounting of the contact spring 13 is provided. To the lower end of the loop 13' there is welded or riveted an arm 20 of a U-shaped stamped bimetal strip 21, the other arm 22 of the strip 21 is secured to a connecting lug 23 by welding or riveting. Into the free end of the bimetal strip 21 there is threadedly engaged a set screw 24 against which abuts a plate-shaped lever 25 onto which the release lever 8 acts by the effect of the arm 11 of the coiled spring 10 pivoting the release lever 8 clockwise as viewed in FIG. 2. The plate-shaped lever 25 extends over the entire pivoting range of the release lever 8 when moved on its ON-OFF positions and vice versa. As is apparent from FIG. 1 the plate-shaped lever 25 has at its left end two aligned protruding dogs 26 whereby the lever 25 is loosely inserted in corresponding recesses of the housing half 1 and is thus mounted so as to be pivotable. The biased arm 11 of the coiled spring 10 thus on the one hand presses the operating cam 12 against the contact spring 13 and on the other hand urges the plate-shaped lever 25 against the set screw 24.

Figure 3:
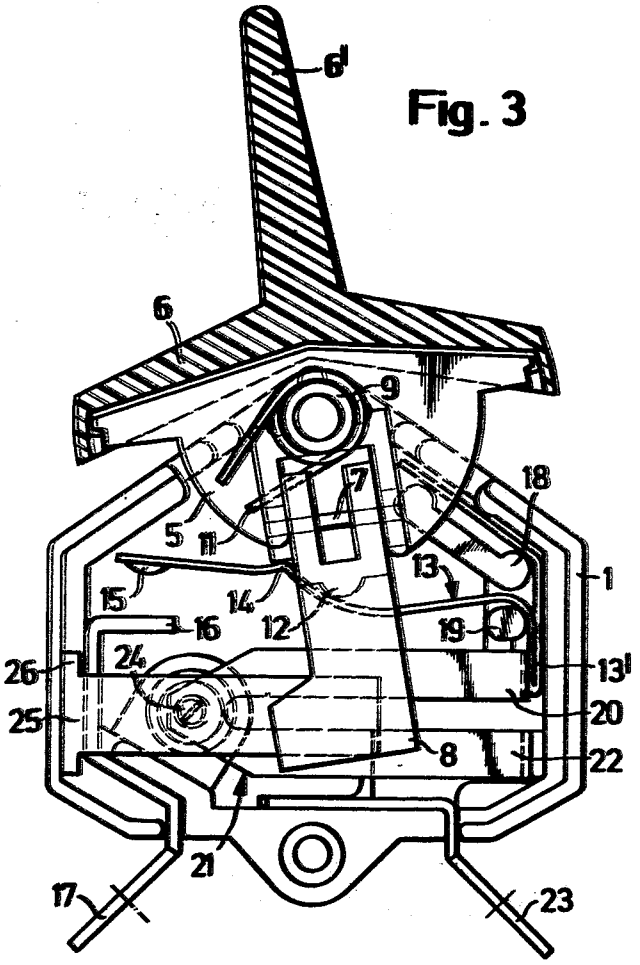
FIG. 3 is a view similar to FIG. 1 with the switch in its OFF position.

When the rocker 6 with the operating lever 5 is pivoted in an anti-clockwise direction from the ON position of FIG. 1, the operating cam 12 moves past the projection 14 of the contact spring 13 and the contact spring 13, by virtue of its inherent resilience, lifts its movable contact piece 15 off the stationary contact piece 16, whereby the OFF position of FIG. 3 is obtained. During the operation of switching on, which takes place from the OFF position of FIG. 3, the operating cam 12 exerts pressure on the contact spring 13 and more particularly on the projection 14 thereof, whereby the ON position of FIG. 1 is obtained. This on- and off-switching operation occurs independently of the bimetal strip 21. Only the contact spring 13 is displaced while the bimetal strip 21 remains unaffected.

Upon the excess current occurring the bimetal strip 21 is heated and bowed in the direction of arrow 27 (FIG. 2). The set screw 24 exerts pressure on the release lever 8 by means of the plate-shaped lever 25 and the release lever 8 is turned about the pin 7, in counter-clockwise sense as viewed in FIG. 2 until the operating cam 12 of the release lever 8 comes out of contact with the contact spring 13. Having been released, the contact spring 13 moves its movable contact piece 15 to the OFF position of FIG. 3. The release of the contact spring 13 by the operating cam 12 occurs when the rocker 6 is constrained in the ON position, so that even then the contact spring 13 can lift its movable contact piece 15 off the stationary counter contact piece 16, whereby trip-free release is obtained. In order to reset the switch, the operating lever 5 has to be returned to its OFF position.

The bimetal strip 21 of FIGS. 1 to 3 is directly heated, while in the embodiment of FIG. 4 the bimetal strip 21' is heated indirectly by a heating winding 28 carried by the bimetal strip 21'. The bimetal strip 21' is welded or riveted to the lower end of the loop 13' of the contact spring 13. The bimetal strip 21' is provided with an electrical insulation 29 onto which the heating winding 28 is wound. One end of the heating winding 28 is conductingly connected with the bimetal strip 21' while the other end is electrically connected to the connecting lug 23. A rocker 6" is engaged on the operating lever 5 as shown in FIG. 4.

FIGS. 5 and 6 show a mounting frame 30 formed as a unitary stamping and bent in the shape of a letter U with the U legs 31 abutting the parallel, oppositely situated wide sides 32 of the housing and each having two aligned U-shaped recesses 33. These U-shaped recesses 33 each form two resilient vertical tongues 34 in the U-legs 31. The two parallel, oppositely situated wide sides 32 of the housing have shallow indentations 35 and 36 the edges of which support the two U legs 31 or the tongues 34. FIGS. 5 and 6 show two different vertical positions of the mounting frame 30 which has been turned 180° relative to the housing. FIG. 5 shows that a spacing of a=4 mm is present between a surface 37 of the rocker 6 and a bearing area 38 for affixing, while the same spacing amounts of only a'=2 mm in FIG. 6. According to FIG. 5 the two tongues 34 are supported by the edges 39 so that the mounting frame 30 is safeguarded against vertically upward displacement on the housing. The mounting frame 30 is safeguarded against downward displacement by the lower edge of the U leg 31 contacting an edge 40. Edges 41 and 42 prevent lateral displacement of the mounting frame 30 on the housing.

According to FIG. 6 the mounting frame turned by 180° is safeguarded against vertically upward displacement by the tongues 34 contacting edges 43. Edges 44 and 45 prevent vertical downward displacement of the mounting frame 30, and edges 46, 47 and 48 prevent the mounting frame 30 shifting laterally on the housing.

The embodiment of the switch shown in FIG. 7 makes it possible to switch a current circuit on or off by actuating the rocker 6. In this embodiment a bimetal strip is not provided and accordingly thermal or trip free release is not possible. In this embodiment contact spring 13 is directly, electrically connected to the connecting lug 23. If desired the release lever 8 may be rigidly connected to the operating lever 5 or form a single piece therewith.

FIG. 8 shows two switches 49, 50 the wide sides of which contact one another and which are held together in this position by a U-shaped bracket 51 adapted to be clipped on from above. A common rocker 52 engages the two operating levers 5. Both switches 49 and 50 may be provided with thermal release facility. Alternatively, only one of the switches 49 or 50 may have thermal release facility while the other switch is a purely mechanical switch for the purpose of switching a current circuit on or off. It is also possible for both switches 49 and 50 to be purely mechanical switches for switching on and off.

When both switches 49 and 50 are purely mechanical ON and OFF switches, then both switches 49 and 50 are switched on or off by the rocker 52. When each of the switches is provided with excess current tripping facility, then each switch 49 and 50 can respond independently of the other switch by trip-free release. It may then happen that only one excess current tripping means responds. Since such switches are mainly used in single phase grids the protection function is fulfilled with single-pole release. By suitable arrangement of the coiled spring 10 the common rocker 52 is moved to the off position. This means that the force of the coiled spring 10 overcomes the projection 14 when only one coiled spring 10 is effective. Correct switching is thereby ensured and the common rocker 52 indicates the operating position in correct optical manner.

We claim:

1. In an electric switch including a housing; an openable and closable electric contact formed of a stationary contact held in the housing and an elongated contact spring clamped at one end in the housing and being urged away from the stationary contact by its resiliency; an operating lever pivotally supported in the housing for swinging in a direction generally parallel to the length dimension of the contact spring; a release lever carried by the operating lever for executing swinging motions in unison with the operating lever; the release lever including an operating cam affixed to the operating lever and cooperating with the contact spring for pressing the contact spring into engagement with the stationary contact in an on-position of the operating lever and for allowing the contact spring to move away from the stationary contact in an off-position of the operating lever, the improvement comprising (a) a shaft held in said housing for pivotally securing said operating lever to said housing;

(b) securing means for pivotally mounting said release lever on said operating lever to provide for a swinging motion of said release lever with respect to said operating lever in a plane transverse to the length dimension of said contact spring;

(c) a torque-exerting spring mounted on said shaft and having one end engaging said housing and having another end engaging said release lever eccentrically with respect to said securing means for urging said release lever into a normal position in which said cam is in an operative position relative to said contact spring and for urging said operating lever, with the intermediary of said release lever, into an off-position; and (d) a bimetal strip held in said housing and having an actuating portion operatively connected to said release lever; said torque-exerting spring urging said release lever in the direction of said actuating portion; said bimetal strip having a normal position and a deformed position; in the normal position of said bimetal strip said cam being maintained in its operative position; said actuating portion of said bimetal strip being arranged to swing said release lever, as said bimetal strip assumes its deformed position, against the spring force exerted on the release lever, for moving said operating cam from its operative position transversely to the length dimension of said contact spring out of engagement therewith to allow said contact spring to move away from said stationary contact independently from the position of said operating lever.

2. An electric switch as defined in claim 1, further comprising a plate-shaped lever mounted in said housing and having opposite first and second faces; said plate-shaped lever extending adjacent said release lever parallel to the direction of the swinging motion of said operating lever and over the entire range of displacement of said release lever executed in unison with said operating lever; said plate-shaped lever being positioned between said release lever and said actuating portion of said bimetal strip; said torque-exerting spring urging said release lever into engagement with said first face of said plate-shaped lever; said actuating portion of said bimetal strip exerting a displacing force on said release lever, upon deformation of said bimetal strip, with the intermediary of said plate-shaped lever by engaging it at said second face thereof.

3. An electric switch as defined in claim 1, wherein said contact spring has a projection oriented towards said operating cam; in said operative position said operating cam engaging said contact spring at the one or the other side of said projection dependent upon the on-position or the off-position of said operating lever.

4. An electric switch as defined in claim 1, further comprising means for passing electric current through said bimetal strip in a closed state of said electric contact for directly heating said bimetal strip.

5. An electric switch as defined in claim 1, further comprising a set screw carried by said bimetal strip and oriented towards said release lever for cooperating with said release lever to adjustably determine the relative position between said bimetal strip and said release lever.

* * * * *